US011162164B2

(12) United States Patent
Park et al.

(10) Patent No.: US 11,162,164 B2
(45) Date of Patent: Nov. 2, 2021

(54) METHOD OF PRODUCING COPPER ALLOY MATERIAL HAVING HIGH STRENGTH AND EXCELLENT BEND ABILITY FOR AUTOMOBILE AND ELECTRICAL/ELECTRONIC COMPONENTS

(71) Applicant: Poongsan Corporation, Pyeongtaek-Si (KR)

(72) Inventors: Cheol Min Park, Ulsan (KR); Jun Hyung Kim, Ulsan (KR); Hyo Moon Nam, Ulsan (KR); Sun Young Mun, Ulsan (KR)

(73) Assignee: Poongsan Corporation, Pyeongtaek-Si (KR)

( * ) Notice: Subject to any disclaimer, the term of this patent is extended or adjusted under 35 U.S.C. 154(b) by 0 days.

(21) Appl. No.: 16/464,290

(22) PCT Filed: Sep. 21, 2018

(86) PCT No.: PCT/KR2018/011198

§ 371 (c)(1),
(2) Date: May 27, 2019

(87) PCT Pub. No.: WO2019/177215

PCT Pub. Date: Sep. 19, 2019

(65) Prior Publication Data

US 2021/0102281 A1 Apr. 8, 2021

(30) Foreign Application Priority Data

Mar. 14, 2018 (KR) ..... 10-2018-0029654

(51) Int. Cl.
*C22F 1/08* (2006.01)
*C21D 8/02* (2006.01)
(Continued)

(52) U.S. Cl.
CPC ..... *C22F 1/08* (2013.01); *C21D 8/0236* (2013.01); *C21D 8/06* (2013.01); *C21D 8/10* (2013.01);
(Continued)

(58) Field of Classification Search
CPC ..... C22F 1/08; C21D 8/0236; C21D 8/06; C21D 8/10; C21D 9/46; C21D 9/0081; C21D 9/08; C22C 1/02; C22C 9/00
See application file for complete search history.

(56) References Cited

U.S. PATENT DOCUMENTS

2012/0267013 A1* 10/2012 Kaneko ..... C22C 9/06 148/554
2016/0160321 A1* 6/2016 Ito ..... C22C 9/00 439/887

FOREIGN PATENT DOCUMENTS

JP 2011026635 A 2/2011
JP 2012012631 A 1/2012
(Continued)

OTHER PUBLICATIONS

Korean Intellectual Property Office, International Search Report, dated Jan. 3, 2019, 8 pages.

*Primary Examiner* — Anthony J Zimmer
*Assistant Examiner* — Jacob J Gusewelle
(74) *Attorney, Agent, or Firm* — Loeb & Loeb LLP

(57) ABSTRACT

The present invention relates a method of producing a copper-titanium (Cu—Ti)-based copper alloy, and provides a method of producing a copper alloy material for automobile and electrical/electronic components requiring high performance by satisfying high strength and bendability together.

8 Claims, 4 Drawing Sheets

(51) Int. Cl.

| | |
|---|---|
| ***C21D 8/06*** | (2006.01) |
| ***C21D 9/00*** | (2006.01) |
| ***C21D 9/46*** | (2006.01) |
| ***C22C 1/02*** | (2006.01) |
| ***C22C 9/00*** | (2006.01) |
| ***C21D 8/10*** | (2006.01) |
| ***C21D 9/08*** | (2006.01) |

(52) U.S. Cl.
CPC ..... *C21D 9/0081* (2013.01); *C21D 9/08* (2013.01); *C21D 9/46* (2013.01); *C22C 1/02* (2013.01); *C22C 9/00* (2013.01)

(56) References Cited

FOREIGN PATENT DOCUMENTS

| | | | |
|---|---|---|---|
| JP | 2012097308 | A | 5/2012 |
| KR | 10-2012-0076387 | A | 7/2012 |
| KR | 10-1627696 | B1 | 6/2016 |

* cited by examiner

METHOD OF PRODUCING COPPER ALLOY MATERIAL HAVING HIGH STRENGTH AND EXCELLENT BEND ABILITY FOR AUTOMOBILE AND ELECTRICAL/ELECTRONIC COMPONENTS

TECHNICAL FIELD

The present invention relates to a method of producing a copper alloy material having high strength and excellent bendability for automobile and electrical/electronic components, and more particularly, a method of producing copper-titanium (Cu—Ti)-based copper alloy materials having high tensile strength and excellent bendability as information transfer and electrical contact materials such as small and precision connectors, spring material, semiconductor lead frames, connectors for automobiles and electrical/electronic devices, and a relay material.

BACKGROUND ART

In the automobile industry, electrics/electronics industry, information and communications industry, and semiconductor industry, electric circuit configurations are becoming more and more complicated with the necessity and demand for environment-friendly materials as well as diversification of functions to be implemented in the final product, and at the same time, there is a demand for realization of high functionality, compact design and high integration of components. Many kinds of copper alloy materials for various connectors, terminals, switches, relays, and lead frames applied to such industrial components, which have been developed to meet the requirements such as high strength, have been used.

Existing copper alloys with a high strength of 950 MPa or higher are copper-beryllium (Cu—Be) alloys with excellent strength and bendability. Due to excellent fatigue resistance and non-magnetic properties, the Cu—Be alloys are mainly used for electrical and electronic components such as precision switches, terminals, and mobile phones. However, since beryllium (Be), which is an additive element, produces dust harmful to the human body during melting/casting and processing, use thereof is expected to be continuously regulated in the future, and the alloys have disadvantage that the manufacturing cost thereof is very high. Therefore, the Cu—Be alloys are being rapidly replaced by copper-titanium (Cu—Ti)-based copper alloys, which have a strength comparable to that of the Cu—Be alloys while not containing beryllium which is a harmful component.

The Cu—Ti-based copper alloys are spinodal decomposition type alloys, whose strength is improved by spinodal decomposition of Ti. Ti forms an intermetallic compound with Cu in a Cu matrix structure and is precipitated into a second phase at grain boundaries or in grains. However, since Ti is very active, it easily forms a compound with an additive element and is consumed. Accordingly, Ti is less effective in suppressing grain-boundary reaction-type precipitation using segregation into the grain boundary. In addition, if the additive element is excessively added, the amount of solid solution of Ti is decreased, thereby offsetting the advantage of the Cu—Ti alloy.

Currently, the commercially available Cu—Ti-based copper alloy materials are limited to the Cu—Ti alloy or the copper-titanium-iron (Cu—Ti—Fe) alloy. Existing filed patent documents disclose many technical attempts to obtain both high strength and high bendability at the same time. Some patent documents disclose that the same effect can be obtained even when various other elements are added to the above-mentioned commercialized alloy components. However, they have failed to present results or commercialize the ideas. Actually, when various elements are added, the bendability is lowered when the strength is increased, and the strength is lowered when the bendability is enhanced. As such, it is very difficult to secure high strength and excellent bendability at the same time.

However, the latest trends in the automobile industry, electrics and electronics industry, information and communications industry, and semiconductor industry require that the copper alloy materials have both high strength capable of withstanding the stress applied during assembly and operation and excellent bendability for processing.

For example, in the case of an automobile connector, as the connector is miniaturized, the connector width is reduced, and the pins of the connector terminals are becoming dense with the number of pins increased from 50-70 to 100 or more. The thicknesses copper alloy material is gradually being decreased from 0.40 mm, 0.30 mm and 0.25 mm to 0.15 mm or less.

In the case of a copper alloy material for electric and electronic components, not only miniaturization of a product according to diversification of functions but also improvement of precision of the shape and dimensions of the product according a complicated shape is required. In particular, as the material is thinner and smaller, it is difficult for strength and bendability to be compatible with each other.

That is, the size and thickness required for copper alloy materials used in the automobile field and the electrics and electronics fields for manufacturing IT and mobile electronic devices are being gradually decreased according to miniaturization and high integration of final products. Accordingly, since a material can be processed into a complicated shape in accordance with an increase in processability due to the narrowing of the material and a decrease in the material thickness, the material should have both high strength for withstanding the stress applied during assembly or operation and excellent bendability for withstanding a harsh bending process. Therefore, the copper alloy material should have a tensile strength of 950 MPa or more and bendability of 90° to 180°. In general, however, the tensile strength tends to be inversely proportional to bendability, which makes it difficult to realize required properties.

In some conventional cases, in order to simultaneously satisfy the strength and the bendability in relation to a method of producing a Cu—Ti-based copper alloy material, research has been conducted on an intensity ratio between of the X-ray diffraction peak intensity of the (200) crystal plane and the X-ray diffraction peak intensity of the (220) crystal plane, which is main peaks of the copper alloy material, through an X-ray diffraction spectroscopy (XRD) analysis of crystal structure of the copper alloy material. For example, when cold rolling is carried out at a high reduction ratio in the process of producing a copper alloy, a rolling texture grows and the X-ray diffraction peak intensity of the (220) crystal plane of the copper alloy material becomes strong. On the contrary, when recrystallization heat treatment is performed, the recrystallized texture grows and the X-ray diffraction peak intensity of the (200) crystal plane becomes strong. However, a product obtained only through cold working is advantageous in securing strength but lacks ductility, which adversely affects the bendability. In contrast, when recrystallization heat treatment is performed, ductility may be secured, but it is difficult to secure strength.

According to recent research trends, research has been actively conducted to realize excellent bendability of the Cu—Ti-based alloy in both the rolling direction and the direction perpendicular to the rolling direction while maintaining high strength.

Korean Patent Application Publication No. 10-2003-0097656 discloses a technique of precipitating a Cu—Ti intermetallic compound of $Cu_{3\sim4}Ti$ by optimizing the heat treatment conditions for hot rolling and solution heat treatment in a production method to improve strength and bendability. The above-mentioned document suggests that the strength and bendability are improved when the intermetallic compound diameter is 0.2 to 3 μm and the number of intermetallic compounds is 700 or less per 1000 $\mu m^2$. However, the method of optimizing the conditions for hot rolling and solution heat treatment disclosed in the above-mentioned patent document is insufficient to satisfy the strength and bendability requirements at the same time.

Korean Patent Application Publication No. 10-2006-0100947 discloses a technique of precipitating a Cu—Ti intermetallic compound to improve strength and bendability. For example, the document discloses suggests that, in the X-ray diffraction spectroscopy (XRD) analysis of crystal structure, when the intensity ratio between the X-ray diffraction peak intensities of the (311) crystal plane and the (111) crystal plane is I(311)/I(111)>0.5, strength and bendability are improved. However, with the technique disclosed in the above-mentioned patent document, the X-ray diffraction peak intensity of the (311) crystal plane is improved, but sufficient bendability is not obtained as the (311) crystal plane is grown by cold rolling with the solute atoms completely dissolved.

Korean Patent Application Publication No. 10-2012-0076387 attempts to improve the bendability while maintaining the tensile strength by improving the production process. For example, the document discloses that, after solution heat treatment, cold rolling and aging treatment, additional cold-rolling is performed, and then a copper alloy material having excellent bendability is finally obtained through annealing for elimination of deformation. The production process of the above-mentioned patent document is advantageous in terms of improvement of strength because the dislocation density is increased due to a change made through final rolling after the aging treatment. However, the disclosed process is rather disadvantageous in terms of bendability.

Korean Patent Application Publication No. 10-2004-0048337 discloses a Cu—Ti-based copper alloy which is improved in bendability and strength by adding a third element. For example, in order to simultaneously achieve excellent bendability and improved strength, a third element group is added to a Cu—Ti alloy to optimize the addition amount of Ti and the addition amount of the third element group, and the proportion of the number of second phase particles is controlled to be 70% or higher of the total of the second phase particles such that the content of the third element group in the second phase particles is greater than or equal to 10 times the content of the third element group in the alloy. However, the above-mentioned patent document is based on the optimization of the additive element, and accordingly there is a limit in satisfying strength and bendability requirements at the same time.

Thus, the copper alloy materials disclosed in the above-mentioned patent documents may have high strength, but it cannot be said that the bendability thereof has been sufficiently improved because the documents disclose only a 90° bend test, that is, a W bend test, in evaluation of the bendability.

SUMMARY

An object of the present invention devised to improve the properties of a copper-titanium (Cu—Ti)-based copper alloy from a different point of view is to provide a copper alloy material for automobile and electrical/electronic components which has excellent tensile strength and bendability and a method of producing the same.

In one aspect of the present invention, provided herein is a method of producing a copper alloy material for automobile and electrical and electronic components, including (a) melting and casting 1.5 to 4.3 wt % titanium (Ti), 0.05 to 1.0 wt % nickel (Ni), a remainder of copper (Cu), and inevitable impurities of 0.8 wt % or less to obtain a slab, wherein the inevitable impurities include one or more elements selected from the group consisting of Sn, Co, Fe, Mn, Cr, Zn, Si, Zr, V and P, and a weight ratio of Ti to Ni (Ti/Ni) is 10<Ti/Ni<18, (b) performing hot working on the slab at a temperature of 750 to 1000° C. for 1 to 5 hours, (c) performing primary cold working at a cold rolling reduction ratio or cold working ratio of 50% or higher, (d) performing intermediate heat treatment at 650 to 780° C. for 5 to 5000 seconds and then performing quenching, (e) performing secondary cold working at a cold rolling reduction ratio or cold working ratio of 50% or higher, (f) performing solution heat treatment at 750 to 1000° C. for 1 to 300 seconds, (g) performing aging treatment at 350 to 600° C. for 1 to 20 hours, (h) performing final cold working cold at a cold rolling reduction ratio or cold working ratio of 5 to 70%, (i) performing stress relief treatment at 300 to 700° C. for 2 to 3000 seconds. In an XRD crystal structure analysis, the copper alloy material satisfies a range of $1<I(220)I_{intermetallic\ compound}(200)+I(200)<4.5$ in terms of a relationship between intensities of X-ray diffraction peaks of (200) and (220) crystal planes corresponding to main peaks of the copper alloy material and an X-ray diffraction peak intensity of an intermetallic compound (200) crystal plane of (Cu, Ni)—Ti.

The copper alloy material may have a tensile strength of 950 MPa or more and satisfies R/t≤1.5(180° in both a rolling direction and a direction perpendicular to the rolling direction. When a structure of a cross section parallel to a rolling direction is observed after the quenching after the intermediate heat treatment in the step (d), an average crystal grain size may be 30 μm or less, the number of (Cu, Ni)—Ti intermetallic compounds appearing in a reflection electron image having an area of 1000 $\mu m^2$ may be 50 or less, and a size of the intermetallic compounds may be less than or equal to 3 μm.

In a structure of a cross section of the finally obtained copper alloy material parallel to a rolling direction, an average crystal grain size is less than or equal to 30 μm, the number of (Cu, Ni)—Ti intermetallic compounds appearing in a reflection electron image having an area of 1000 $\mu m^2$ is greater than or equal to 800, and a size of the intermetallic compounds is less than or equal to 500 nm.

The steps (e), (f), (g) and (h) may be repeated twice to five times as necessary. The method may further include correcting a plate shape before or after the aging treatment.

The method may further include performing tin (Sn), silver (Ag), or nickel (Ni) plating after the stress relief treatment.

The method may further include producing a plate, a rod, or pipe after the stress relief treatment.

The present invention provides a copper alloy material for an automobile connector and electrical/electronic components which has excellent tensile strength and bendability, and a method of producing the same.

DETAILED DESCRIPTION

Figure 1:
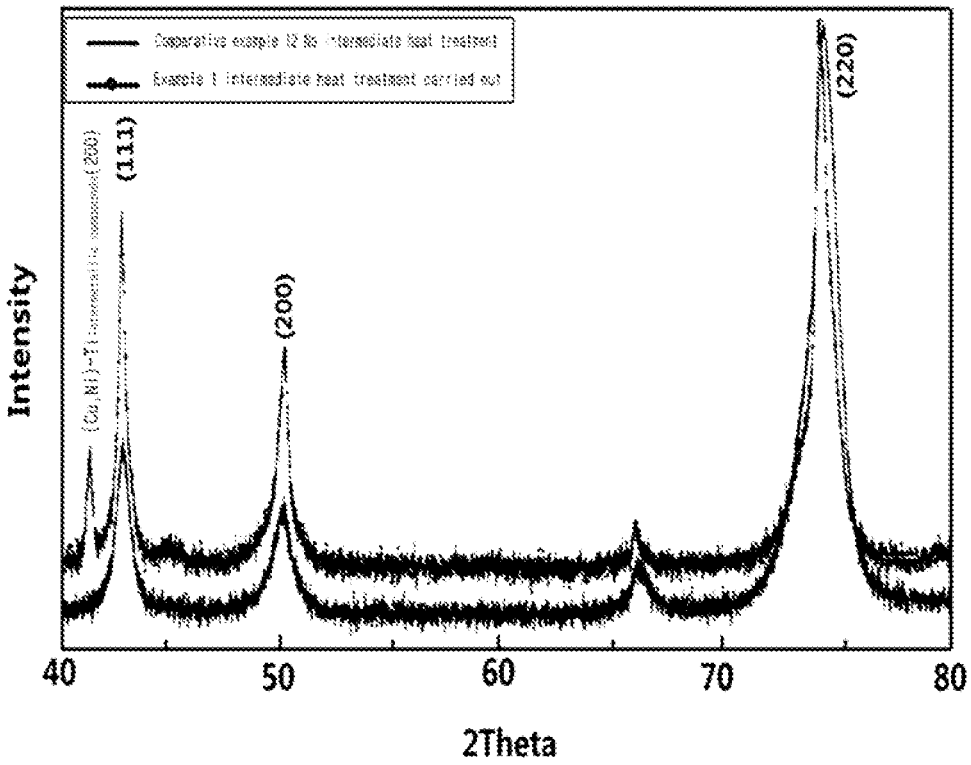
FIG. 1 is a graph depicting crystal structures of copper-titanium-nickel (Cu—Ti—Ni) alloys of Example 1 and Comparative Example 12 in an X-ray diffraction spectroscopy (XRD) analysis.

The present invention provides a method of producing a copper alloy material having improved strengths including a tensile strength and improved bendability at the same time. In the present specification, when % is used as an indication of the content, it means weight % (wt %) unless otherwise indicated.

Copper Alloy Material of the Present Invention

The copper alloy material of the present invention includes 1.5 to 4.3 wt % titanium (Ti), 0.05 to 1.0 wt % nickel (Ni), a remainder of copper (Cu), and inevitable impurities. The weight ratio of Ti to Ni (Ti/Ni) satisfies 10<Ti/Ni<18, and the inevitable impurities are one or more elements selected from the group consisting of Sn, Co, Fe, Mn, Cr, Zn, Si, Zr, V, and P.

Hereinafter, the constituent elements constituting the copper alloy material of the present invention and the reason for limiting the elements will be described.

(1) Ti

Ti is an element that contributes to improvement of the strength by forming an intermetallic compound with Ni. The content of Ti in the copper alloy material according to the present invention ranges from 1.5 to 4.3 wt %. When the content of Ti is lower than 1.5 wt %, sufficient strength may not be secured in the aging treatment, and thus the material may be unsuitable for use in automobile and electrical/electronic connectors, semiconductors and lead frames. When the content of Ti exceeds 4.3 wt %, side cracks are generated and bendability is lowered in hot working due to the crystals formed in casting.

(2) Ni

Ni is an element that contributes to improvement of the strength by forming an intermetallic compound with Ti. The content thereof ranges from 0.05 to 1.0 wt %. Adding Ni to the copper-titanium (Cu—Ti)-based copper alloy may suppress coarsening of crystal grains of intermetallic compound during the solution heat treatment, thereby enabling the solution heat treatment to be carried out at a higher temperature and sufficiently dissolving Ti. The content of Ni lower than 0.05 wt % is insufficient to obtain the above-described effect. However, if added Ni exceeds 1.0 wt % to secure the strength, the amount of Ti consumed by the Ni—Ti intermetallic compound increases, resulting in deterioration of the strength and bendability.

(3) Weight Ratio of Ti to Ni (Ti/Ni)

In the copper alloy material according to the present invention, titanium and nickel serve to form a copper and nickel-titanium ((Cu, Ni)—Ti) intermetallic compound, which contributes to strength and bendability, in the Cu matrix. Here, the weight ratio of Ti to Ni (Ti/Ni) contained in the copper alloy material is 10<Ti/Ni<18. When the weight ratio of Ti/Ni is less than or equal to 10.0, the amount of Ti consumed by the (Cu, Ni)—Ti intermetallic compound increases, resulting in deterioration of strength and bendability. When the weight ratio of Ti/Ni is greater than or equal to 18.0, the effect of enhancement of strength according to the addition of Ni may not be obtained. Therefore, the weight ratio of Ti/Ni in the composition of the copper alloy material according to the present invention is 10<Ti/Ni<18.

(4) Impurities (Sn, Co, Fe, Mn, Cr, Zn, Si, Zr, V, and P)

The copper alloy material according to the present invention may include one or more elements selected from the group consisting of Sn, Co, Fe, Mn, Cr, Zn, Si, Zr, V and P as impurities. The impurities are not intentionally added, but are naturally added in the production processes of the copper alloy material such as melting and casting. In the aging process, the impurities form an intermetallic compound together with (Cu, Ni)—Ti so as to be precipitated in the matrix structure to increase the strength. The total amount of the impurities is lower than or equal to 0.8 wt %. If the total amount of the impurities exceeds 0.8 wt %, a large amount of Ti—Ni—X-based intermetallic compounds (wherein X means the above-mentioned impurities) is precipitated, resulting in abrupt deterioration of strength and bendability.

The copper alloy material according to the present invention has a tensile strength of 950 MPa or more, and satisfies R/t≤1.5(180°) in both the rolling direction and the direction perpendicular to the rolling direction.

In the copper alloy material according to the present invention, the tensile strength is at least 950 MPa, and preferably at least 1000 MPa. If the tensile strength is less than 950 MPa, the material may not withstand the stress applied during assembly or operation of automobile components or electrical/electronic components. Accordingly, a tensile strength of 950 MPa or more is required The copper alloy material according to the present invention has bendability satisfying R/t≤1.5(180°) in both the rolling direction and the direction perpendicular to the rolling direction, and preferably R/t≤1.0(180°) in both the rolling direction and the direction perpendicular to the rolling direction. When the R/t value for bendability exceeds 1.5(180°), bending cracks are produced in the process of bending a narrow product, and thus it is difficult to apply the material to the product having a small size or a complex shape. Accordingly, bendability satisfying R/t≤1.5(180°) is required.

Hereinafter, a method of producing the copper alloy material according to the present invention will be described.

Method of Producing Copper Alloy Material According to the Present Invention

Conventionally, a Cu—Ti-based copper alloy material is generally produced in a sequence of melting/casting, hot rolling, repetition of heat treatment and cold rolling, solution heat treatment, cold rolling, and aging treatment.

On the other hand, the copper alloy material according to the present invention is obtained by the following production method proposed to achieve the characteristics of the present invention.

The copper alloy material according to the present invention is produced according to a method including (a) melting and casting 1.5 to 4.3 wt % titanium (Ti), 0.05 to 1.0 wt % nickel (Ni), a remainder of copper (Cu), and inevitable impurities of 0.8 wt % or less to obtain a slab, wherein the inevitable impurities include one or more elements selected from the group consisting of Sn, Co, Fe, Mn, Cr, Zn, Si, Zr, V and P, and a weight ratio of Ti to Ni (Ti/Ni) is in a range of 10<Ti/Ni<18 (melting and casting); (b) performing hot working on the slab at a temperature of 750 to 1000° C. for 1 to 5 hours (hot working); (c) performing primary cold working at a cold rolling reduction ratio or cold working ratio of 50% or higher (primary cold working); (d) performing intermediate heat treatment at 650 to 780° C. for 5 to 5000 seconds and then performing quenching (intermediate heat treatment); (e) performing secondary cold working at a cold rolling reduction ratio or cold working ratio of 50% or higher (secondary cold working); (f) performing solution heat treatment at 750 to 1000° C. for 1 to 300 seconds (solution heat treatment); (g) performing aging treatment at 350 to 600° C. for 1 to 20 hours (aging treatment); (h) performing final cold working cold at a final cold rolling reduction ratio or cold working ratio of 5 to 70% (final cold working); (i) performing stress relief treatment at 300 to 700° C. for 2 to 3000 seconds (stress relief treatment).

Specific conditions for producing the copper alloy material according to the present invention are as follows.

(a) Melting and Casting

To produce the copper alloy material according to the present invention described above, 1.5 to 4.3 wt % Ti, 0.05 to 1.0 wt % Ni, and a remainder of Cu are added, melted using a vacuum melting furnace to prevent oxidization of Ti, and then subjected to casting in an inert gas atmosphere to obtain a slab. Here, the weight ratio of Ti to Ni (Ti/Ni) is in a range of $10<Ti/Ni<18$. The above-mentioned inevitable impurities may be involved in the above-described process, but the total amount thereof should be controlled so as not to exceed 0.8 wt %.

(b) Hot Working

The hot working may be performed at a temperature of 750 to 1000° C. for 1 to 5 hours, preferably at 850 to 950° C. for 2 to 4 hours. When the hot working is performed at a temperature lower than or equal to 750° C. or within 1 hour, the cast structure remains, and the probability that defects such as cracks will be produced during the hot working is high, resulting in low strength and bendability in the finished product. When the hot working is performed at a temperature higher than or equal to 1000° C. or perform for 5 hours or more, the crystal grains become coarse, and the bendability is deteriorated while a finished product thickness is produced.

(c) Primary Cold Working

After the hot working, the primary cold working is performed at room temperature. The primary cold rolling reduction ratio or cold working ratio is 50% or higher. When the primary cold working ratio is lower than 50%, sufficient precipitation is not driven in the Cu matrix structure, and thus recrystallization is delayed in the solution heat treatment process, which is carried out continuously in a short time. Accordingly, the lower ratio is disadvantageous for the solution heat treatment.

(d) Intermediate Heat Treatment

This is the most important process step in forming an X-ray diffraction peak intensity of the $I_{intermetallic\ compound}$ (200) crystal plane, which is a (Cu, Ni)—Ti intermetallic compound in the XRD crystal structure analysis of the finally obtained copper alloy material. Only when the conditions for composition control and intermediate heat treatment of the present invention are satisfied, high strength and bendability may be obtained in the final product at the same time by producing and controlling (Cu, Ni)—Ti intermetallic compounds.

The intermediate heat treatment is a process that is usually performed in the copper alloy production process. In order to produce a thin copper alloy material, many cold working processes are performed. Accordingly, it is known that the intermediate heat treatment is a process of softening the material through heat treatment (for the purposes of annealing, recrystallization and softening) and rework between the cold working processes to produce a final product. Some conventional technologies have introduced intermediate heat treatment conceptually corresponding to over-aging treatment for the purpose of precipitation, not for recrystallization and softening, but the introduced intermediate heat treatment is a conceptually different process from the typical intermediate heat treatment (for the purposes of annealing, recrystallization and softening) because it is carried out at a low temperature for the purpose of aging hardening. In fact, when precipitation hardening and aging hardening-type alloys are subjected to the low-temperature intermediate heat treatment process conceptually corresponding to the aging treatment, a large amount of precipitates is produced, and therefore the number of precipitates to be produced in the actual aging treatment becomes very small. As a result, high strength may not be obtained. After the intermediate heat treatment, the strength is abruptly increased due to increase of the precipitates, thereby causing cracks in the subsequent rolling process, which limits production of the finished product. Accordingly, the purpose of the intermediate heat treatment intended for softening may not be achieved.

Even if the above-mentioned typical intermediate heat treatment (for the purposes of annealing, recrystallization and softening) is carried out, the properties of the copper alloy material according to the present invention may not be attained if the product is out of the composition range and process range defined in the present invention.

The intermediate heat treatment of the present invention is carried out at 650 to 780° C. for 5 to 5000 seconds, followed by quenching within a few seconds. When the temperature of the intermediate heat treatment exceeds 780° C., some (Cu, Ni)—Ti intermetallic compounds precipitated during the intermediate heat treatment are completely redissolved and fine intermetallic compounds are not sufficiently precipitated in the final product. As a result, the tensile strength may be lowered, and cracks may be produced during a bending process. When the temperature of the intermediate heat treatment is lower than 650° C., a large amount of (Cu, Ni)—Ti intermetallic compounds may be precipitated, and thus a second phase intermetallic compound may not be formed in the final product. Thereby, the final product may not secure a tensile strength. In addition, if quenching is not performed after the intermediate heat treatment in the above-mentioned temperature range, a large amount of precipitates is produced in the process of cooling the product (material) to room temperature after the heat treatment, and accordingly it is not possible to satisfy both high strength and bendability with the final product.

Only when the conditions for the intermediate heat treatment process are all satisfied, the intensity ratio of the X-ray diffraction peak intensity of the (200) crystal plane, which is the main crystal plane of the copper alloy material, the X-ray diffraction peak intensity of the (220) crystal plane, and the X-ray diffraction peak intensity of the intermetallic compound (200) crystal plane of (Cu, Ni)—Ti may satisfy the condition of $1<I(220)/I_{intermetallic\ compound}(200)+I(200)<4.5$ in the XRD crystal structure analysis of the completed copper alloy material according to the present invention. Referring to FIG. 1, a difference according to the intermediate heat treatment process may be confirmed.

Some (Cu, Ni)—Ti intermetallic compounds having a size of 0.3 to 3 μm are formed according to the intermediate heat treatment process in step (d). Specifically, in the structure of the cross section parallel to the rolling direction, the average crystal grain size is 30 μm or less, the number of (Cu, Ni)—Ti intermetallic compounds appearing in a reflection electron image having an area of 1000 $\mu m^2$ is 50 or less, and an intermetallic compound having a size of 3 μm or less is produced. Thereafter, when secondary cold working is performed at the cold rolling reduction ratio or cold working ratio of 50% or higher and then solution heat treatment is performed, the (Cu, Ni)—Ti intermetallic compound produced during the intermediate heat treatment may be redissolved, and a larger amount of fine (Cu, Ni)—Ti intermetallic compounds is formed in solution heat treatment, aging treatment and final cold working. Thereby, high strength and bendability may be obtained together.

(e) Secondary Cold Working

The intermediate heat treatment is followed by the secondary cold working. The secondary cold rolling reduction ratio or cold working ratio is higher than or equal to 50%. As the cold rolling reduction ratio or cold working ratio before the solution heat treatment increases, the (Cu, Ni)—Ti intermetallic compound may be finely and uniformly distributed in the solution heat treatment. Accordingly, it is advantageous to carry out the cold working at the cold rolling reduction ratio or cold working ratio of 50% or higher.

(f) Solution Heat Treatment

The solution heat treatment is an important process for obtaining high strength and excellent bendability. The solution heat treatment may be carried out at 750 to 1000° C. for 1 to 300 seconds, preferably at 800 to 900° C. for 10 to 60 seconds. When the solution heat treatment is performed at a temperature lower than 750° C. or performed for less than 1 second, sufficient supersaturation may not be formed, and thus the (Cu, Ni)—Ti intermetallic compound is not sufficiently precipitated after the aging treatment. Thereby, the tensile strength and the yield strength are deteriorated. When the solution heat treatment is performed at a temperature higher than or equal to 1000° C. or performed for over 300 seconds, the grain size increases to 50 μm or more and the bendability is deteriorated. In particular, the bendability is sharply deteriorated in the rolling direction.

(g) Aging Treatment

The aging treatment is carried out to improve properties such as strength, elongation, electrical conductivity and bendability. Aging may occur at a temperature of 350 to 600° C. for 1 to 20 hours. In this period, generation and growth of (Cu, Ni)—Ti-based fine intermetallic compounds occur at grain boundaries and in the Cu matrix structure during solution heat treatment and final cold working, and the strength and bendability are improved. When the aging treatment is carried out at a temperature lower than 350° C. or carried out for less than 1 hour, (Cu, Ni)—Ti intermetallic compounds are not sufficiently generated and grown in the Cu matrix structure due to lack of heat, and thus the tensile strength and the bendability are low. When the aging treatment is carried out at a temperature exceeding 600° C. or carried out for over 20 hours, the over-aging region is reached and the bendability reaches the maximum value, but the tensile strength is reduced.

(h) Final Cold Working

The aging treatment is followed by final cold working. The cold rolling reduction ratio or cold working ratio of the final cold working is 5 to 70%. When the cold rolling reduction ratio or cold working ratio is lower than 5%, the X-ray diffraction peak intensity of the (220) crystal plane, which contributes to improvement of the strength, is not sufficiently formed, and the tensile strength is remarkably decreased. When the cold rolling reduction ratio or cold working ratio of the final cold working is higher than 70%, the X-ray diffraction peak intensity of the (200) crystal plane, which contributes to improvement of the bendability, is decreased and the bendability is greatly lowered.

(i) Stress Relief Treatment

The stress relief treatment may be carried out at 300 to 700° C. for 2 to 3000 seconds, preferably at 500 to 600° C. for 10 to 300 seconds. The stress relief treatment is a process of relieving the stress formed by deformation of the obtained product by applying heat. Particularly, the stress relief treatment performs an important function to restore the elastic strength after the plate shape correction. When the stress relief treatment is performed at a temperature lower than or equal to 300° C. or performed for less than 2 seconds, the loss of elastic strength due to the plate shape correction may not be sufficiently recovered. When the treatment is performed at a temperature higher than 700° C. or performed for over 3000 seconds, softening may occur beyond the maximum recovery interval of the elastic strength, and thus mechanical properties such as tensile strength and elastic strength may be deteriorated.

In the production method, the steps from (e) the second cold working to (h) the final cold working may be repeatedly performed twice to five times as needed. That is, the steps may be repeatedly performed according to the thickness of the final product due to a decrease in thickness of the copper alloy material according to a recent compact design and high integration of automobile and electrical/electronic components.

The plate shape correction may be performed according to the plate shape state of the material (product) before or after the aging treatment.

After the stress removal step, tin (Sn), silver (Ag), and nickel (Ni) plating may be performed if necessary.

The method may further include a step of fabricating a plate, a rod, or a pipe depending on the application. This step is available after the stress removal step regardless of plating. Specifically, the plate may be fabricated to have a thickness of 0.03 to 2.5 mm, and the rod and pipe may be fabricated to have an outer diameter of 0.5 to 500Φ(=mm).

The crystal grain size (or grain diameter) of the copper alloy material obtained by the production method according to the present invention may be confirmed by analyzing the structure of a cross section parallel to the rolling direction. The average crystal grain size greatly affects the strength and bendability of the copper alloy material. In order to satisfy both the tensile strength and the bendability according to the present invention, the structure of the cross section parallel to the rolling direction of the copper alloy material has an average crystal grain size of 30 μm or less. When the average crystal grain size on the cross section is larger than 30 μm, it is advantageous in terms of securing strength, but is disadvantageous in terms of bendability because it leads to cracking in the bending process.

In addition, in the structure of a cross section parallel to the rolling direction of the copper alloy material obtained by the production method according to the present invention, the number of (Cu, Ni)—Ti intermetallic compounds appearing in a reflection electron image having an area of 1000 $\mu m^2$ is 800 or more, and the size of the intermetallic compounds is 500 nm or less. When the (Cu, Ni)—Ti intermetallic compounds appearing in a reflection electron image having an area of 1000 $\mu m^2$ is 800 or more and the size thereof is 500 nm or less as described above, a strength of 950 MPa or more and bendability satisfying $R/t \leq 1.5$ (180°) may be obtained. When the number of the intermetallic compounds is 800 or less, a strength of 950 MPa or more may not be obtained. Even if the number of the intermetallic compounds is 800 or more, the size less than or equal to 500 nm may cause the surface of the material (product) to be easily roughened or cracked during bending. Therefore, the size of the intermetallic compounds is preferably 500 nm or less.

The copper alloy material for automobile and electrical/electronic components exhibiting excellent strength and excellent bendability as obtained by the production method according to the present invention has a unique X-ray diffraction spectroscopy (XRD) crystal structure.

The X-ray diffraction pattern of the conventional copper alloy material usually includes X-ray diffraction peaks of four crystal planes of (111), (200), (220), and (311), and the X-ray diffraction peaks of the other crystal planes are not analyzed because the intensities thereof are significantly weaker than those of the four crystal planes. In a typical method of producing a copper alloy, the X-ray diffraction peak intensities of the (200) crystal plane and the (311) crystal plane are increased after heat treatment (annealing or solution heat treatment), which means that recrystallization occurs through the heat treatment and thus the material becomes ductile and thus has enhanced bendability. Then, when the cold working is carried out, the crystal planes are reduced, and the X-ray diffraction peak intensity of the (220) crystal plane increases. In this case, the strength increases, but the bendability is lowered.

On the other hand, in the XRD crystal structure analysis of the copper alloy material obtained by the production method according to the present invention, the intensity ratio of the X-ray diffraction peak intensity of the (200) crystal plane, which is the main crystal plane of the copper alloy material, the X-ray diffraction peak intensity of the (220) crystal plane, and the X-ray diffraction peak intensity of the intermetallic compound (200) crystal plane of (Cu, Ni)—Ti should satisfy the condition of $1<I(220)/I_{intermetallic\ compound}(200)+I(200)<4.5$. Here, I(200) and I(220) denote the X-ray diffraction peak intensities of the crystal planes of the copper alloy material, and $I_{intermetallic\ compound}(200)$ denotes the X-ray diffraction peak intensity of the crystal plane of the (Cu,Ni)—Ti intermetallic compound.

For the copper alloy material obtained by the production method according to the present invention, (Cu, Ni)—Ti intermetallic compounds are produced through the composition control of the present invention, and are finely distributed in the Cu matrix through control of the conditions and sequence in the production processes including the intermediate heat treatment, the solution heat treatment, the aging treatment, and the final rolling. The X-ray diffraction intensity of the (200) crystal plane of the (Cu, Ni)—Ti intermetallic compound, which is the main crystal plane, is denoted by $I_{intermetallic\ compound}(200)$. When the intensity relationship between the X-ray diffraction peak intensities I(220) and I(220) of the (200) and (220) crystal planes of the copper alloy material according to the present invention, which are the main crystal planes, and the X-ray diffraction peak intensity $I_{intermetallic\ compound}(200)$ of the (200) crystal plane of the intermetallic compound, which is the main crystal plane, is controlled to satisfy $1<I(220)/I_{intermetallic\ compound}(200)+I(200)<4.5$, both excellent strength and excellent bendability may be achieved. That is, only when $I(220)/I_{intermetallic\ compound}(200)+I(200)$, which represents a value obtained by dividing the X-ray diffraction peak intensity of the (220) crystal plane of the copper alloy material, which contributes to the strength, by the sum of the X-ray diffraction peak intensity $I_{intermetallic\ compound}(200)$ of the intermetallic compound crystal plane of (Cu, Ni)—Ti, which contributes to the strength and the bendability, and the X-ray diffraction peak intensity of the (200) crystal plane of the copper alloy material, which is favorable to the bendability, is in the above-mentioned range, the properties according to the present invention may be obtained. When the value is less than 1, the (200) crystal plane contributing to the bendability develops and thus the strength is lowered. When the value is greater than or equal to 4.5, the (220) crystal plane contributing to the strength develops and the bendability is lowered.

The copper alloy material obtained by the method of producing a copper alloy material according to the present invention has a tensile strength of 950 MPa or more and satisfies $R/t\leq1.5(180°)$ in both the rolling direction and the direction perpendicular to the rolling direction.

The copper alloy material obtained by the production method according to the present invention has a tensile strength of 950 MPa or more, preferably 1000 MPa or more. When the tensile strength is less than 950 MPa, the material may not withstand the stress applied during assembly or operation of automobile components or electrical/electronic components. Accordingly, a tensile strength of 950 MPa or more is required.

The copper alloy material obtained by the production method according to the present invention has bendability satisfying $R/t\leq1.5(180°)$ in both the rolling direction and the direction perpendicular to the rolling direction, and preferably $R/t\leq1(180°)$ in both the rolling direction and the direction perpendicular to the rolling direction. When the R/t value for bendability exceeds 1.5(180°), bending cracking occurs in the process of bending a narrow product, and it is difficult to apply the material to the product having a small size or a complex shape. Accordingly, bendability satisfying $R/t\leq1.5(180°)$ is required.

The copper alloy material obtained by the production method according to the present invention satisfies the strength and bendability properties as described above. Specifically, the copper alloy material has a tensile strength of 950 MPa and satisfies $R/t\leq1.5(180°)$ in both the rolling direction and the direction perpendicular to the rolling direction. For details about the properties, refer to the description related to the copper alloy material.

EXAMPLES

Examples 1 to 10

The above-described copper alloy material according to the present invention was produced with the compositions shown in Table 1 under the process conditions shown in Table 2 below. Specifically, a copper alloy slab having a total weight of 2 kg, a thickness of 25 mm, a width of 100 mm and a length of 150 mm was produced by mixing the constituent elements according to the compositions disclosed in Table 1 and then performing melting and casting using a vacuum melting/casting apparatus. In order to fabricate a plate, the copper alloy slab was maintained at 950° C. for 2 hours, and then subjected to hot working for up to 11 mm and cooled in water. Then, the opposite surfaces of the slab were face-cut to a thickness of 0.5 mm to remove the oxide scale. After the primary cold working was performed to reduce the thickness to 3.5 mm by 65%, an intermediate heat treatment was carried out according to a temperature and time shown in Table 2. Subsequently, the secondary cold working was carried out to reduce the thickness to 0.4 mm by 88.6%, and the solution heat treatment, the aging treatment and the final cold working were sequentially performed according to the conditions disclosed in Table 2. Thereby, a plate specimen of the finished thickness according to the final cold working ratio was fabricated.

Comparative Examples 1 to 12

Corresponding comparative examples were produced in the same manner as the production method of the above-mentioned examples, based on the specific conditions as disclosed in Tables 1 and 2.

Table 1 shows the constituent elements of a copper alloy material for each of the examples and comparative examples.

TABLE 1

| Item | | Chemical composition (wt %) Cu | Ti | Ni | Impurities | Ti/Ni ratio (%) |
|---|---|---|---|---|---|---|
| Example | 1 | Remainder | 3.2 | 0.25 | — | 12.8 |
| | 2 | Remainder | 3 | 0.25 | — | 15 |
| | 3 | Remainder | 3.5 | 0.2 | — | 17.5 |
| | 4 | Remainder | 3.2 | 0.25 | P0.01 | 12.8 |
| | 5 | Remainder | 4 | 0.25 | — | 16 |
| | 6 | Remainder | 2.5 | 0.2 | — | 12.5 |
| | 7 | Remainder | 3.2 | 0.25 | Zn0.02 | 12.8 |
| | 8 | Remainder | 3.8 | 0.35 | — | 10.8 |
| | 9 | Remainder | 3.2 | 0.25 | — | 12.8 |
| | 10 | Remainder | 3.2 | 0.25 | — | 12.8 |
| Comparative example | 1 | Remainder | 3.2 | — | — | — |
| | 2 | Remainder | 5 | 0.25 | — | 20 |
| | 3 | Remainder | 1 | 0.25 | — | 4 |
| | 4 | Remainder | 3.2 | 0.25 | — | 12.8 |
| | 5 | Remainder | 3.2 | 0.25 | — | 12.8 |
| | 6 | Remainder | 3.2 | 0.25 | — | 12.8 |
| | 7 | Remainder | 3.2 | 0.5 | Co0.35, Cr0.5 | 6.4 |
| | 8 | Remainder | 3.2 | 0.5 | Sn0.35, Cr0.5 | 6.4 |
| | 9 | Remainder | 3.2 | — | Fe0.2 | — |
| | 10 | Remainder | 3.2 | 0.25 | — | 12.8 |
| | 11 | Remainder | 3.2 | 0.25 | P0.02 | 12.8 |
| | 12 | Remainder | 3.2 | 0.25 | — | 12.8 |

Table 2 shows the conditions for the production processes of the copper alloy material.

TABLE 2

| Item | | Process: Intermediate heat treatment (° C. × sec.) | Secondary cold working (Reduction ratio in %) | Solution heat treatment (° C. × sec.) | Aging (° C. × hours) | Final cold working (Reduction ratio in %) |
|---|---|---|---|---|---|---|
| Example | 1 | 700 × 1800 | 88.6 | 830 × 50 | 400 × 5 | 10 |
| | 2 | 700 × 1800 | 88.6 | 830 × 50 | 400 × 5 | 15 |
| | 3 | 700 × 3600 | 88.6 | 830 × 50 | 400 × 5 | 10 |
| | 4 | 780 × 1200 | 88.6 | 830 × 50 | 400 × 5 | 20 |
| | 5 | 700 × 1800 | 88.6 | 830 × 50 | 400 × 5 | 10 |
| | 6 | 700 × 3600 | 88.6 | 830 × 50 | 400 × 5 | 20 |
| | 7 | 700 × 1800 | 88.6 | 830 × 50 | 400 × 5 | 15 |
| | 8 | 700 × 3600 | 88.6 | 830 × 50 | 400 × 5 | 10 |
| | 9 | 650 × 1800 | 88.6 | 830 × 50 | 400 × 5 | 15 |
| | 10 | 680 × 1800 | 88.6 | 830 × 50 | 400 × 5 | 15 |
| Comparative example | 1 | 700 × 1800 | 88.6 | 830 × 50 | 400 × 5 | 10 |
| | 2 | 700 × 1800 | 88.6 | 830 × 50 | 400 × 5 | 10 |
| | 3 | 700 × 3600 | 88.6 | 830 × 50 | 400 × 5 | 20 |
| | 4 | 850 × 1800 | 88.6 | 830 × 50 | 400 × 5 | 15 |
| | 5 | 600 × 18000 | 88.6 | 830 × 50 | 400 × 5 | 15 |
| | 6 | 700 × 1800 | 88.6 | 830 × 50 | 400 × 5 | 75 |
| | 7 | Cracks in hot rolling | | | | |
| | 8 | | | | | |
| | 9 | 700 × 1800 | 88.6 | 830 × 50 | 400 × 5 | 10 |
| | 10 | 700 × 1800 | 88.6 | 830 × 50 | 300 × 5 | 15 |
| | 11 | 700 × 1800 | 88.6 | 830 × 50 | 600 × 5 | 15 |
| | 12 | — | 88.6 | 830 × 50 | 400 × 5 | 15 |

The tensile strength, the bendability, the size and number of intermetallic compounds, and the crystal structures of the intermetallic compound and the copper alloy material were evaluated for each of the obtained specimens using the following methods.

Test Example (Tensile Strength)

The tensile strength was measured in the rolling direction in accordance with JIS Z 2241 using a tensile tester. The results are shown in Table 3.

(Bendability)

When the inner bending radius is R and the material thickness is t, the bend test was conducted by making a complete contact in a direction (good way direction) perpendicular to the rolling direction and a direction (bad way direction) parallel to the rolling direction (U bend test with 180° complete contact under a condition of $R/t \leq 1.5$, where R is a radius of curvature and t is a thickness of the material), and then the material was observed using an optical microscope. Cases where cracks were not observed were marked with O, and cases where cracks were observed were marked with X in the evaluation. The results are shown in Table 3.

(Average Crystal Grain Size)

The final specimen was subjected to mechanical polishing. Then, crystal grain sizes were measured in a reflection electron image having an area of 1000 $mm^2$ at 5000 times magnification with FE-SEM (Manufacturer: FEI, USA) and then the average crystal grain size was obtained, using a crystal grain size measurement method based on the line analysis (intercept method or Heyn's method).

(Size and Number of Intermetallic Compounds)

After the final specimen was subjected to mechanical polishing, measurement was performed at 5000 times magnification using FE-SEM (Manufacturer: FEI, USA). Then, the size and number of intermetallic compounds appearing in a reflection electron image having an area of 1000 $mm^2$ were visually identified. The results are shown in Table 3.

TABLE 3

| Item | | Mechanical properties: Tensile strength (MPa) | Bendability (180° R/t ≤ 1.5) | Average crystal grain size (μm) | (Cu,Ni)—Ti intermetallic compound: Average size (nm) | Number (1000 $\mu m^2$) |
|---|---|---|---|---|---|---|
| Example | 1 | 989 | ○ | 6 | 150 | 920 |
| | 2 | 965 | ○ | 8 | 160 | 879 |
| | 3 | 1020 | ○ | 13 | 187 | 998 |
| | 4 | 992 | ○ | 6 | 150 | 915 |
| | 5 | 1050 | ○ | 18 | 195 | 1020 |
| | 6 | 952 | ○ | 7 | 155 | 832 |
| | 7 | 985 | ○ | 6 | 152 | 935 |

TABLE 3-continued

| Item | | Mechanical properties: Tensile strength (MPa) | Mechanical properties: Bendability (180° R/t ≤ 1.5) | Average crystal grain size (μm) | (Cu,Ni)—Ti intermetallic compound: Average size (nm) | (Cu,Ni)—Ti intermetallic compound: Number (1000 μm²) |
|---|---|---|---|---|---|---|
| | 8 | 1030 | ○ | 15 | 192 | 1005 |
| | 9 | 980 | ○ | 18 | 165 | 823 |
| | 10 | 988 | ○ | 19 | 162 | 829 |
| Comparative example | 1 | 940 | ○ | 38 | 250 | 10 |
| | 2 | 1120 | X | 27 | 215 | 1185 |
| | 3 | 885 | ○ | 7 | 623 | 360 |
| | 4 | 890 | X | 26 | 1150 | 153 |
| | 5 | 875 | X | 22 | 195 | 623 |
| | 6 | 1090 | X | 47 | 452 | 885 |
| | 7 | Cracks in hot rolling | | | | |
| | 8 | | | | | |
| | 9 | 945 | X | 6.5 | 189 | 50 |
| | 10 | 905 | X | 12 | 158 | 755 |
| | 11 | 825 | ○ | 8 | 152 | 1210 |
| | 12 | 980 | X | 65 | 189 | 450 |

(XRD crystal Structure Analysis)

After the specimen was cut to a size of 0.5 cm×0.5 cm, the crystal structure was analyzed through XRD (Manufacturer: Panalytical, Netherlands). Then, the X-ray diffraction peak intensities of the (200) and (220) crystal planes, which are the main peaks of the copper alloy material, and the X-ray diffraction peak intensity of the $I_{intermetallic\ compound}(200)$ crystal plane of (Cu, Ni)—Ti were obtained using a High Score Plus program. Some of the results are disclosed in FIG. 1. FIG. 1 shows XRD results of Example 1 and Comparative Example 12. FIG. 1 is a graph depicting crystal structures in X-ray diffraction spectroscopy (XRD) analysis of Cu—Ti—Ni alloys of Example 1 and Comparative Example 12.

The X-ray diffraction peak intensities of the (200) and (220) crystal planes, which are the main peaks of the copper alloy material, the X-ray diffraction peak intensity of the $I_{intermetallic\ compound}(200)$ crystal plane of (Cu, Ni)—Ti, and the values of $I(220)/I_{intermetallic\ compound}(200)+I(200)$ representing the relationship between the peak intensities are shown in Table 4.

TABLE 4

| Item | | $I_{intermetallic\ compound}$ (200) | I(200) | I(200) | I(220)/ $I_{intermetallic\ compound}$ (200) + I(220) |
|---|---|---|---|---|---|
| Example | 1 | 31.63 | 7.47 | 100 | 2.55 |
| | 2 | 28.96 | 5.47 | 100 | 2.90 |
| | 3 | 33.2 | 7.35 | 100 | 2.46 |
| | 4 | 32.23 | 5.32 | 100 | 2.66 |
| | 5 | 36.23 | 7.92 | 100 | 2.26 |
| | 6 | 23.2 | 6.23 | 100 | 3.39 |
| | 7 | 32.57 | 7.85 | 100 | 2.47 |
| | 8 | 35.14 | 7.85 | 100 | 2.32 |
| | 9 | 27.5 | 7.89 | 100 | 2.82 |
| | 10 | 25.3 | 6.52 | 100 | 3.14 |
| Comparative example | 1 | 0 | 9.58 | 100 | 10.43 |
| | 2 | 41.2 | 8.42 | 100 | 2.01 |
| | 3 | 3.6 | 7.25 | 100 | 9.21 |
| | 4 | 47.5 | 30.2 | 100 | 1.28 |
| | 5 | 1.33 | 3.52 | 100 | 20.61 |
| | 6 | 31.4 | 2.45 | 100 | 2.95 |
| | 7 | Cracks in hot rolling | | | |
| | 8 | | | | |
| | 9 | 0 | 7.56 | 100 | 13.22 |
| | 10 | 30.25 | 7.45 | 100 | 2.65 |
| | 11 | 32.42 | 6.98 | 100 | 2.53 |
| | 12 | 4.2 | 5.3 | 100 | 10.52 |

Figure 2A:
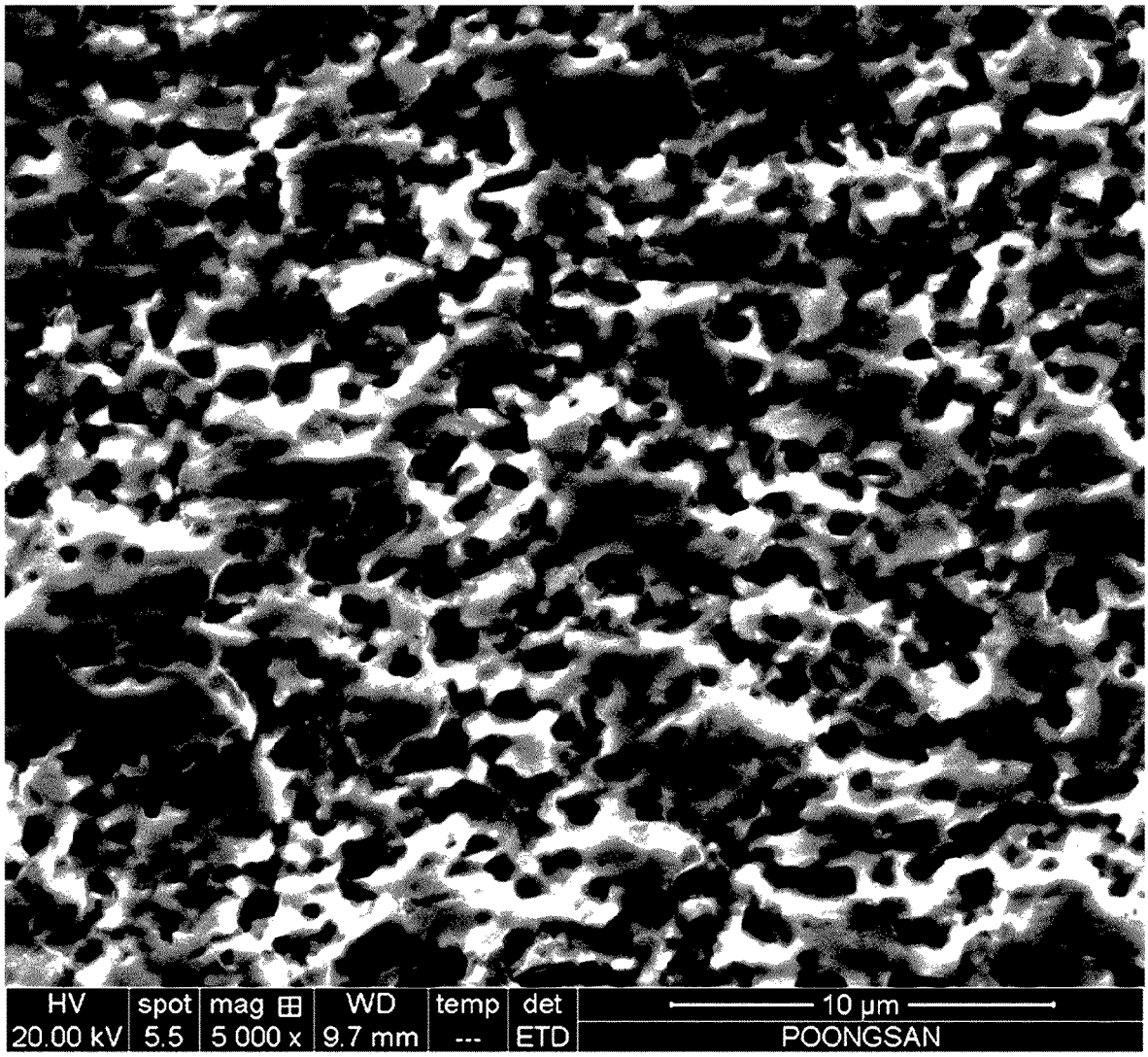
FIG. 2A is a view showing the microstructure of a Cu—Ti—Ni alloy of Example 1.
Figure 2B:
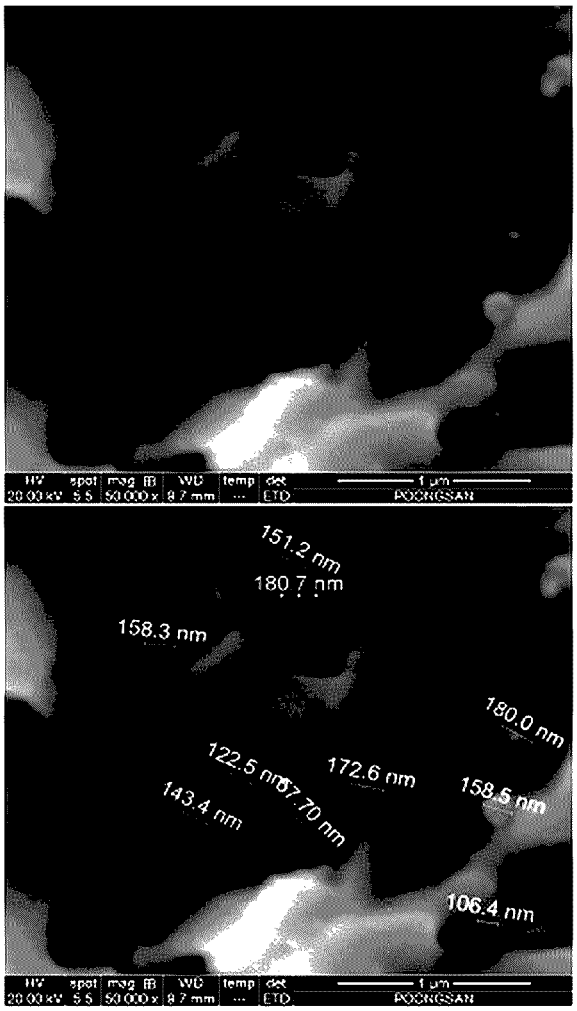
FIG. 2B is an enlarged view of FIG. 2A, showing the number and size of intermetallic compounds of the Cu—Ti—Ni alloy of Example 1.
Figure 3:
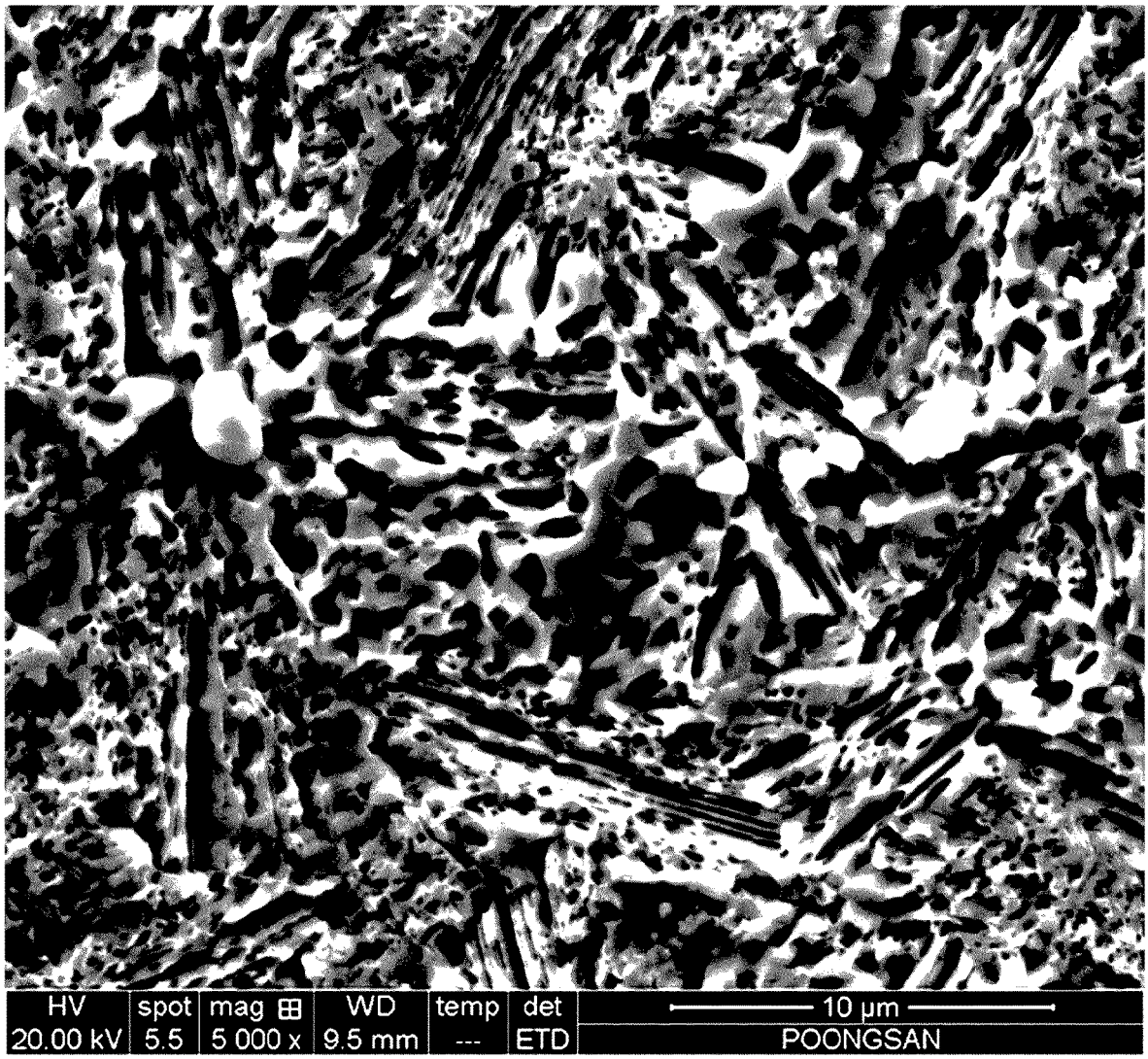
FIG. 3 is a view showing the microstructure of the Cu—Ti—Ni alloy of Example 1 after an intermediate heat treatment.

Referring to Tables 3 and 4, the specimens produced according to Examples 1 to 10 had a tensile strength of 950 MPa or more and cracks were not produced in the specimens in the rolling direction and the direction perpendicular to the rolling direction in the 180° U bend test under the condition of R/t≤1.5. In the XRD crystal structure analysis, the X-ray diffraction peak intensity ratio was in the range of $1<I(220)/I_{intermetallic\ compound}(200)+I(200)<4.5$ (where I(200) and I(220) denote the X-ray diffraction peak intensities of the crystal planes of the copper alloy material, and $I_{intermetallic\ compound}(200)$ denotes the X-ray diffraction peak intensity of the crystal plane of the (Cu, Ni)—Ti intermetallic compound). In the present invention, the microstructures before and after the intermediate heat treatment were analyzed and it was found that the properties were changed depending on the grain size, the number and distribution pattern of intermetallic compounds. Specifically, it was confirmed that the copper alloy material subjected to the intermediate heat treatment in Example 1 significantly differed from the copper alloy material not subjected to the intermediate heat treatment as in Comparative Example 12 in terms of the crystal grain size, and the number and size of intermetallic compounds. In the case of the material not subjected to the intermediate heat treatment as in Comparative Example 12, the grain size was 50 μm or more, the rolled structure was developed, and no (Cu, Ni)—Ti intermetallic compound was produced. In the case of the specimen of the copper alloy material produced according to Example 1, as shown in FIG. 3, the grain size was as fine as 20 μm, the number of (Cu, Ni)—Ti intermetallic compounds appearing in a reflection electron image having an area of 1000 μm² was 50 or less, and the size of the intermetallic compounds was 3 μm or less. Then, when cold rolling was carried out at a reduction ratio higher than or equal to 50% and then the solution heat treatment is carried out, some intermetallic compounds formed in the intermediate heat treatment were redissolved. Thereafter, when the secondary intermediate working, solution heat treatment, aging treatment and final cold working were performed, the number of intermetallic compounds of (Cu, Ni)—Ti appearing in a reflection electronic image of an area of 1000 μm² per observation field was 800 or more as shown in FIG. 2A, and fine intermetallic compounds having a size of 500 nm or less were uniformly distributed in the matrix structure. Thus, it was confirmed that the strength and bendability were simultaneously improved.

On the other hand, in Comparative Example 1, Ni was not added and thus the bendability was excellent. However, improvement in strength by the intermetallic compounds was not expected. In Comparative Example 2, the ratio of titanium-nickel (Ti—Ni) was 18 or more, and cracking occurred in the bending process. In Comparative Example 3, the ratio of Ti—Ni was less than 10, and sufficient strength was not secured. In Comparative Example 4, the temperature of the intermediate heat treatment was higher than 780° C. Thus, some (Cu, Ni)—Ti intermetallic compounds precipitated in the intermediate heat treatment were completely redissolved and fine intermetallic compounds were not sufficiently precipitated in the final product. Accordingly, the tensile strength was lowered and cracking occurred in the bending process. In Comparative Example 5, the temperature of the intermediate heat treatment was 600° C., which is much lower than 650° C., and heat treatment was carried for a long time. As a result, a large amount of (Cu, Ni)—Ti intermetallic compounds was precipitated, and thus the strength was drastically increased. In addition, side cracks are generated starting at the point of 40% in the subsequent process (rolling), which made it difficult to produce the finished product. Thus, In the final aging treatment, the second-phase intermetallic compound was not formed, and thus both the strength and the bendability were significantly reduced in the final product. In Comparative Example 6, the final rolling was 70% or more, the X-ray diffraction peak intensity of the (200) crystal plane, which is favorable to bendability, was reduced. Thus, bendability was not secured. In Comparative Examples 7 and 8, other elements such as Co and Sn were added to the alloys, and the total amount of impurities was 0.8 wt % or more. As a result, side cracks were formed during hot working, and thus a finished sample was not obtained. In Comparative Example 9, iron (Fe) was added to the alloy. (Cu, Ni)—Ti intermetallic compounds were not formed after the intermediate heat treatment claimed in the present invention, and thus sufficient strength and bendability were not secured. In Comparative Example 10, the (Cu, Ni)—Ti intermetallic compounds were not completely formed in the aging process at 300° C. or lower, and the tensile strength and bendability were lowered. In Comparative Example 11, as the over-aging region was approached at a temperature higher than or equal to 600° C. in the aging process, the bendability was good, but the tensile strength was drastically lowered. In Comparative Example 12, as described above, the average crystal grain size was greater than or equal to 50 μm, the rolled structure was developed, and no (Cu, Ni)—Ti intermetallic compound was formed.

As described above, in the present invention, in the XRD crystal structure analysis of the copper alloy material obtained by the above-described production process including the control of the Ti—Ni ratio and the intermediate heat treatment, that the intensity relationship between the X-ray diffraction peak intensities of the (200) and (220) crystal planes, which are the main peaks of the copper alloy material, and the X-ray diffraction peak intensity of the $I_{intermetallic\ compound}(200)$ crystal plane of (Cu, Ni)—Ti satisfied the range of $1<I(220)/I_{intermetallic\ compound}(200)+I(200)<4.5$, and also satisfied the condition of $R/t\leq 1.5(180°)$ in both the rolling direction and the direction perpendicular to the rolling direction at a tensile strength of 950 MPa or more in terms of bendability. Thus, it was conformed that the strength and the bendability were improved together. That is, the copper alloy material according to the present invention is a material very suitable for use in electrical and electronic components such as connectors that will be evolved to be lightweight, compact, and highly dense in the future.

What is claimed is:

1. A method of producing a copper alloy material for automobile and electrical and electronic components, comprising:

(a) melting and casting 1.5 to 4.3 wt % titanium (Ti), 0.05 to 1.0 wt % nickel (Ni), a remainder of copper (Cu), and inevitable impurities of 0.8 wt % or less to obtain a slab, wherein the inevitable impurities are one or more elements selected from the group consisting of Sn, Co, Fe, Mn, Cr, Zn, Si, Zr, V and P, and a weight ratio of Ti to Ni (Ti/Ni) is $10<Ti/Ni<18$;

(b) performing hot working on the slab at a temperature of 750 to 1000° C. for 1 to 5 hours;

(c) performing primary cold working at a cold rolling reduction ratio or cold working ratio of 50% or higher;

(d) performing intermediate heat treatment at 650 to 780° C. for 5 to 5000 seconds and then performing quenching;

(e) performing secondary cold working at a cold rolling reduction ratio or cold working ratio of 50% or higher;

(f) performing solution heat treatment at 750 to 1000° C. for 1 to 300 seconds;

(g) performing aging treatment at 350 to 600° C. for 1 to 20 hours;

(h) performing final cold working cold at a cold rolling reduction ratio or cold working ratio of 5 to 70%; and (i) performing stress relief treatment at 300 to 700° C. for 2 to 3000 seconds, wherein, in an XRD crystal structure analysis, the copper alloy material satisfies a range of $1<1(220)I_{intermetallic\ compound}(200)+I(200)<4.5$ in terms of a relationship between intensities of X-ray diffraction peaks of (200) and (220) crystal planes corresponding to main peaks of the copper alloy material and an X-ray diffraction peak intensity of an intermetallic compound (200) crystal plane of (Cu, Ni)—Ti.

2. The method according to claim 1, wherein the copper alloy material has a tensile strength of 950 MPa or more and satisfies $R/t)\leq 1.5(180°)$ in both a rolling direction and a direction perpendicular to the rolling direction.

3. The method according to claim 1, wherein, when a product obtained through the quenching after the intermediate heat treatment in the step (d) is observed, a structure of a cross section of the product parallel to a rolling direction has an average crystal grain size of 30 μm or less, the number of (Cu, Ni)—Ti intermetallic compounds appearing in a reflection electron image having an area of 1000 $\mu m^2$ is 50 or less, and a size of the intermetallic compounds is less than or equal to 3 μm.

4. The method according to claim 1, wherein, in a structure of a cross section of the finally obtained copper alloy material parallel to a rolling direction, an average crystal grain size is less than or equal to 30 μm, the number of (Cu, Ni)—Ti intermetallic compounds appearing in a reflection electron image having an area of 1000 $\mu m^2$ is greater than or equal to 800, and a size of the intermetallic compounds is less than or equal to 500 nm.

5. The method according to claim 1, wherein the steps (e), (f), (g) and (h) are repeated twice to five times.

6. The method according to claim 1, further comprising: correcting a plate shape before or after the aging treatment.

7. The method according to claim 1, further comprising: performing tin (Sn), silver (Ag), or nickel (Ni) plating after the stress relief treatment.

8. The method according to claim 1, further comprising: producing a plate, a rod, or pipe after the stress relief treatment.

* * * * *